US005893797A

United States Patent [19]

Marino et al.

[11] Patent Number: 5,893,797

[45] Date of Patent: Apr. 13, 1999

[54] HAND-HELD MULTI-FUNCTION ELECTRONIC LOTTERY DEVICE

[76] Inventors: John S. Marino, E. Mountain Rd. South, Cold Spring, N.Y. 10516; Anthony J. Marino, 1 Tarrywile Lake Rd., Danbury, Conn. 06810

[21] Appl. No.: 08/851,211

[22] Filed: May 5, 1997

[51] Int. Cl.[6] ..... A63F 9/22

[52] U.S. Cl. ..... 463/46; 463/17

[58] Field of Search ..... 463/46, 44, 19, 463/18, 17, 16; 273/148.13, 269; 364/410.1, 411.1, 412.1; 361/600, 679

[56] References Cited

U.S. PATENT DOCUMENTS

| | | | |
|---|---|---|---|
| 4,378,940 | 4/1983 | Gluz et al. | 273/269 X |
| 4,455,025 | 6/1984 | Itkis | 273/269 X |
| 4,858,122 | 8/1989 | Kreisner | 364/410 |
| 5,133,554 | 7/1992 | Piccinini, Sr. | 273/148 R |
| 5,157,602 | 10/1992 | Fields et al. | 364/412 |
| 5,158,294 | 10/1992 | Piro | 273/148 R |
| 5,178,389 | 1/1993 | Bentley et al. | 273/138 A |
| 5,286,023 | 2/1994 | Wood | 273/138 A |
| 5,354,069 | 10/1994 | Guttman et al. | 273/439 |
| 5,356,144 | 10/1994 | Fitzpatrick et al. | 273/138 A |
| 5,743,801 | 4/1998 | Wilander | 463/44 |

*Primary Examiner*—Michael O'Neill
*Attorney, Agent, or Firm*—Richard L. Miller, P.E.

[57] ABSTRACT

A hand-held multi-function electronic lottery device that is holdable in a hand of a user and has a user lottery ticket with a user lottery ticket number thereon insertable therethrough. The hand-held multi-function electronic lottery device includes a housing, a keypads a magnifier ticket reader windows and an L.E.D display. The housing has a front with a lower portion and an upper portion, a back with an upper portion that has a slot therethrough for inserting the user lottery ticket therethrough, a top, a bottom, and a pair of sides. The keypad is disposed on the housing. The magnifier ticket reader window is disposed on the housing and allows the user lottery ticket number on the user lottery ticket to be magnified and viewed therethrough when the user lottery ticket is inserted through the slot in the housing. The L.E.D. display is disposed on the housing. The hand-held multi-function electronic lottery device further includes a "main" routine that is utilized to input data, a "pick" sub-routine that is utilized to randomally pick numbers, a "best" sub-routine that is utilized to display the most frequently occurring winning lottery numbers, and a "replay" sub-routine that is utilized to store a selected group of lottery numbers.

19 Claims, 17 Drawing Sheets

HAND-HELD MULTI-FUNCTION ELECTRONIC LOTTERY DEVICE

BACKGROUND OF THE INVENTION

1. Field of the Invention

The present invention relates to a lottery device. More particularly, the present invention relates to a hand-held multifunction electronic lottery device.

2. Description of the Prior Art

Lotto games are contests in which a series of single or double digit numbers are preselected. These numbers are then printed on lotto tickets prior to drawing.

While there are numerous variations of lotto tickets depending on the game, generally these tickets have the preselected numbers arranged one after the other in consecutive lines.

Numerous innovations for lottery related devices have been provided in the prior art that will be described. Even though these innovations may be suitable for the specific individual purposes to which they address, however, they differ from the present invention.

FOR EXAMPLE, U.S. Pat. No. 4,858,122 to Kreisner teaches a random lottery computer which can be preprogrammed for various lottery markets. Lotteries vary in the number of selections to be made, the range for each selection, and whether the selections are single digit or double digit. A microprocessor controlled system, with random number generation, is programmed for these various lottery parameters by a game selector switch and by push button switches which increment or decrement the selection range. The lottery computer may be battery powered or light powered. Provision is made for initializing the microprocessor when power is first applied. Power is also disconnected after a given interval.

ANOTHER EXAMPLE, U.S. Pat. No. 5,133,554 to Piccinini, Sr. teaches a lotto ticket card holder for viewing numbers thereon and for comparing the viewed numbers with the current winning combination. The holder includes a front sheet and a back sheet that is joined thereto along one side edge thereof. A transverse magnifier is attached to the front sheet, so that a lotto ticket may be held and slid between the front and back sheets between the top and bottom edges thereof for viewing the respective lines of numbers printed on the ticket. A "magic" slates is provided on which the current winning combination may be noted. This "magic slate" is secured to the front sheet immediately adjacent to the magnifier, so that the viewed numbers may be easily compared with the winning combination that is noted thereon.

STILL ANOTHER EXAMPLE U.S. Pat. No. 5,157,602 to Fields et al. teaches a device for generating winning lotto and keno combinations. The invention comprises means for inputting a number comporting to the total size of a lottery number pool; keypad means for inputting a minimum winning prize level, means in accordance with a prestored algorithm for generating a plurality of number combinations utilizing each number in the number pool; and means for outputting the number combinations. The number combinations guaranteeing a winning combination at a minimum prize level.

YET ANOTHER EXAMPLE, U.S. Pat. No. 5,158,294 to Piro teaches a lottery card marking apparatus that provides a housing receiving a lottery card therewithin, with at least a top wall formed with a matrix of openings to coincide with free-positioned marking indicia on the lottery card.

Optionally, the housing may include a rear wall with aligned apertures relative to the apertures to the forward wall to permit projection of a piercing instrument through the lottery card for marking purposes. Further, a modification includes a plurality of locking lug members slidably mounted to the right and left side edges of the housing to effect locking an alignment of the card within the housing during a marking procedure.

STILL YET ANOTHER EXAMPLE, U.S. Pat. No. 5,178,389 to Bentley et al. teaches a game device, preferably hand-held, that has an electronic display pattern generator, a display, and a play button to initiate generation of a game which displays sets of symbols which "rotate" after the manner of a fruit machine and which can be held from "rotating" by a hold button. The device includes the capability of limiting the number of games playable, and a lock button allows a winning display to be locked irrevocably to establish proof of a win.

YET STILL ANOTHER EXAMPLE, U.S. Pat. No. 5,286,023 to Wood teaches a video lottery game having a video-display and a processor for enabling a player to play and a method of playing a video lottery game. Jackpot prize schedules are calculated and displayed for viewing by the player. Responsive to the displayed jackpot prize schedules, a player's bet is received and displayed. A plurality of objects are randomly selected and are then displayed at a speed responsive to a player selection. Game results are evaluated and displayed responsive to the randomly selected and displayed objects.

STILL YET ANOTHER EXAMPLE, U.S. Pat. No. 5,354,069 to Guttman et al. teaches a lottery by phone system which permits a caller to place bets with a state's existing lottery computer system via a telephone call from a touch-tone telephone which is connected via the public telephone network to a voice response unit which decodes touch-tones entered by the caller. The voice response unit prompts the caller with preprogrammed digitized audio messages and has each caller identified via a unique identification number. It permits such a caller to select which game to place a bet with and to have the option of picking their own numbers or having the system randomly pick numbers for them. It allows the caller to collect their winnings using a touch tone telephone via another telephone call, and to have the automatic interaction with the caller handle data entry errors, and to have caller queries regarding previous such bets answered by an operator. The system communicates with the existing state lottery computer via emulation of the existing communications protocol used between the existing state lottery computer and on-line terminals and performs automatic high level error recovery beyond the specifications of that communications protocol FINALLY, YET STILL ANOTHER EXAMPLE, U.S. Pat. No. 5,356,144 to Fitzpatrick et al. teaches a random number generating device for generating a plurality of random numbers. The device comprises means for inputting at least one set of user defined parameters from which the plurality of random numbers are selected. In a preferred embodiment, the device is capable of generating random numbers pursuant to six stored games, four of which allow a user to input parameters, with the remaining two games capable of generating random numbers akin to numbers generated upon the rolling of a pair of dice and the spinning of a Roulette Wheel.

It is apparent that numerous innovations for lottery related devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a hand-held multi-function electronic lottery device that avoids the disadvantages of the prior art.

ANOTHER OBJECT of the present invention is to provide a hand-held multi-function electronic lottery device that is simple and inexpensive to manufacture STILL ANOTHER OBJECT of the present invention is to provide a hand-held multi-function electronic lottery device that is simple to use.

BRIEFLY STATED, YET ANOTHER OBJECT of the present invention is to provide a hand-held multi-function electronic lottery device that is holdable in a hand of a user and has a user lottery ticket with a user lottery ticket number thereon insertable therethrough. The hand-held multi-function electronic lottery device includes a housing, a keypad, a magnifier ticket reader window and an L.E.D. The housing has a front with a lower portion and an upper portion, a back with an upper portion that has a slot therethrough for inserting the user lottery ticket therethrough, a top, a bottom, and a pair of sides. The keypad is disposed on the housing. The magnifier ticket reader window is disposed on the housing and allows the user lottery ticket number on the user lottery ticket to be magnified and viewed therethrough when the user lottery ticket is inserted through the slot in the housing. The L.E.D. display is disposed on the housing. The hand-held multi-function electronic lottery device further includes a "main" routine that is utilized to input data, a "pick" sub-routine that is utilized to randomally pick numbers, a "best" sub-routine that is utilized to display the most frequently occurring winning lottery numbers, and a "replay" sub-routine that is utilized to store a selected group of lottery numbers.

The novel features which are considered characteristic of the present invention are set forth in the appended 3 claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
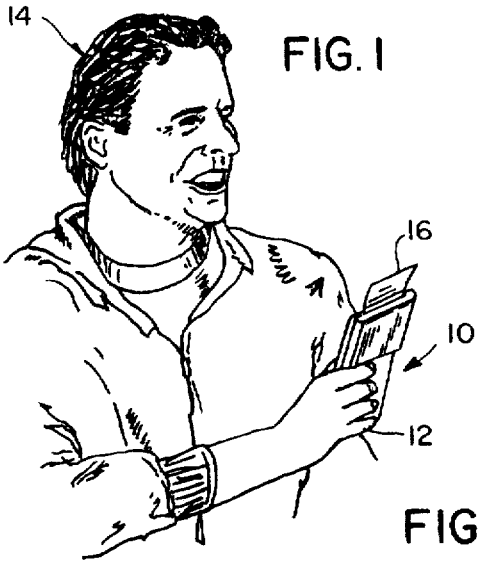
FIG. 1 is a diagrammatic perspective view of a user holding the present invention, with a user lottery ticket inserted therein, in his hand and visually determining that the user lottery ticket contains a winning lottery number.

10 hand-held multi-function electronic lottery device of the present invention
12 hand of user 14
14 user
16 user lottery ticket of user 14
18 housing
20 front of housing 18
22 back of housing 18
24 upper portion 24 of back 22 of housing 18
26 top of housing 18
28 bottom of housing 18
30 pair of sides of housing 18
32 top of upper portion 24 of back 22 of housing 18
34 bottom of upper portion 24 of back 22 of housing 18
36 slot in upper portion 24 of back 22 of housing 18
38 user lottery ticket number
40 lower portion of front 20 of housing 18
42 keypad on lower portion 40 of front 20 of housing 18
44 "delete" key of keypad 42 on lower portion 40 of front 20 of of housing 18
46 "win num" key of keypad 42 on lower portion 40 of front 20 of housing 18
48 "input num" key of keypad 42 on lower portion 40 of front 20 of housing 18
50 "pick" key of keypad 42 on lower portion 40 of front 20 of housing 18
52 "best" key of keypad 42 on lower portion 40 of front 20 of housing 18
54 "replay" key of keypad 42 on lower portion 40 of front 20 of housing 18
56 "0" key of keypad 42 on lower portion 40 of front 20 of housing 18
58 "1" key of keypad 42 on lower portion 40 of front 20 of housing 18
60 "2" key of keypad 42 on lower portion 40 of front 20 of housing 18
62 "3" key of keypad 42 on lower portion 40 of front 20 of housing 18
64 "4" key of keypad 42 on lower portion 40 of front 20 of housing 18
66 "5" key of keypad 42 on lower portion 40 of front 20 of housing 18
68 "6" key of keypad 42 on lower portion 40 of front 20 of housing 18
70 "7" key of keypad 42 on lower portion 40 of front 20 of housing 18
72 "8" key of keypad 42 on lower portion 40 of front 20 of housing 18
74 "9" key of keypad 42 on lower portion 40 of front 20 of housing 18
76 upper portion of front 20 of housing 18
78 magnifier ticket reader window on upper portion 76 of front 20 of housing 18
80 L.E.D. display on upper portion 76 of front 20 of housing 18
82 solar cell on upper portion 76 of front 20 of housing 18

DETAILED DESCRIPTION OF THE PREFERRED EMBODIMENT

Referring now to the figures, and particularly to FIG. 1, the hand-held multi-function electronic lottery device of the present invention is shown generally at 10 being held in a hand 12 of a user 14, with a user lottery ticket 16 inserted therein and with the user 14 visually determining that the user lottery ticket 14 contains a winning lottery number.

Figure 3:
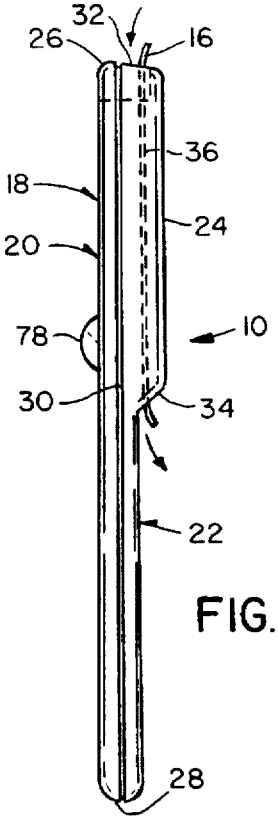
FIG. 3 is a diagrammatic side elevational view taken generally in the direction of arrow 3 in FIG. 2 and illustrating the path of the user lottery ticket inserted therethrough.
Figure 2:
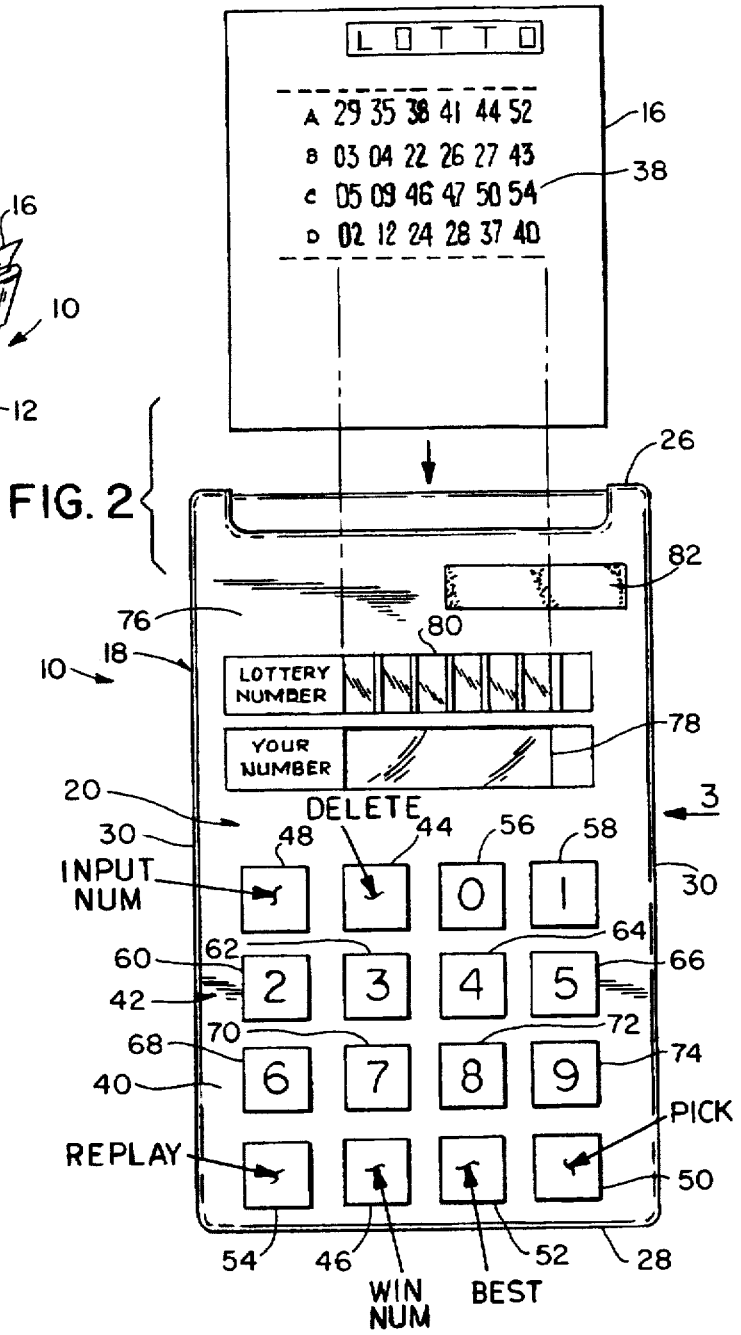
FIG. 2 is an enlarged diagrammatic front elevational view of the present invention with the user lottery ticket being inserted therein.
Figure 4A:
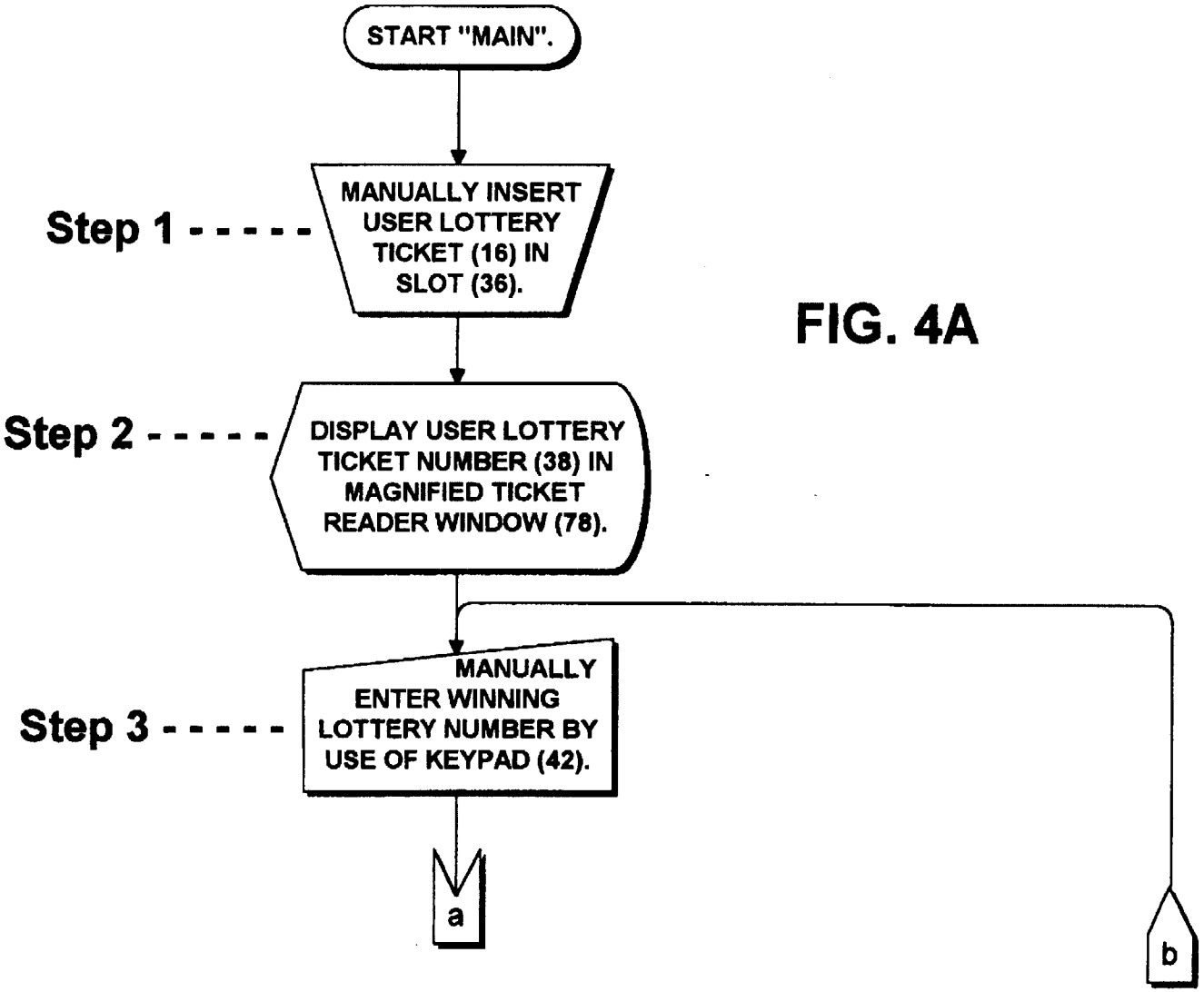
FIGS. 4A–4F is a process chart of the "main " routine of the present invention.
Figure 4B:
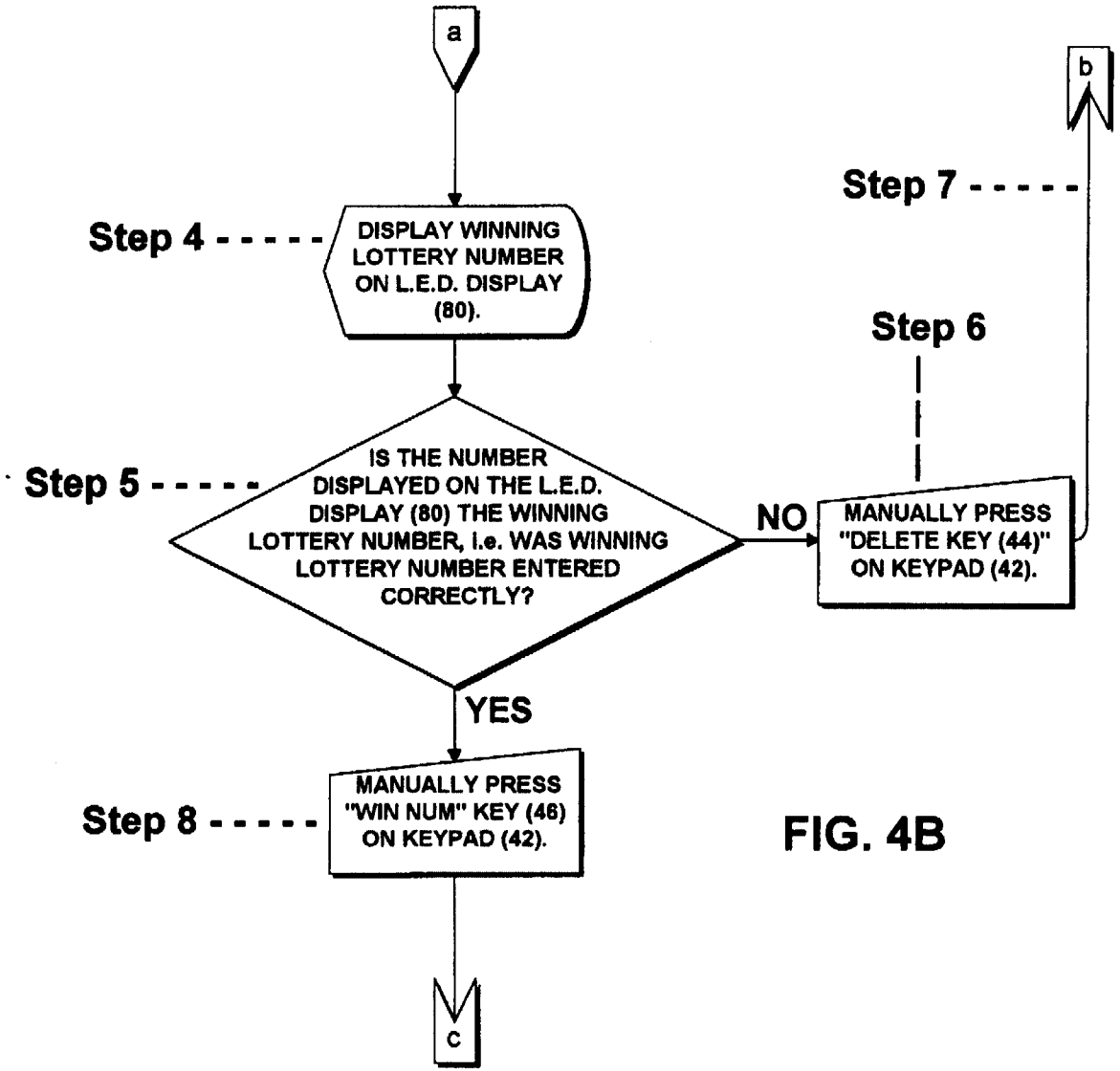
Figure 4C:
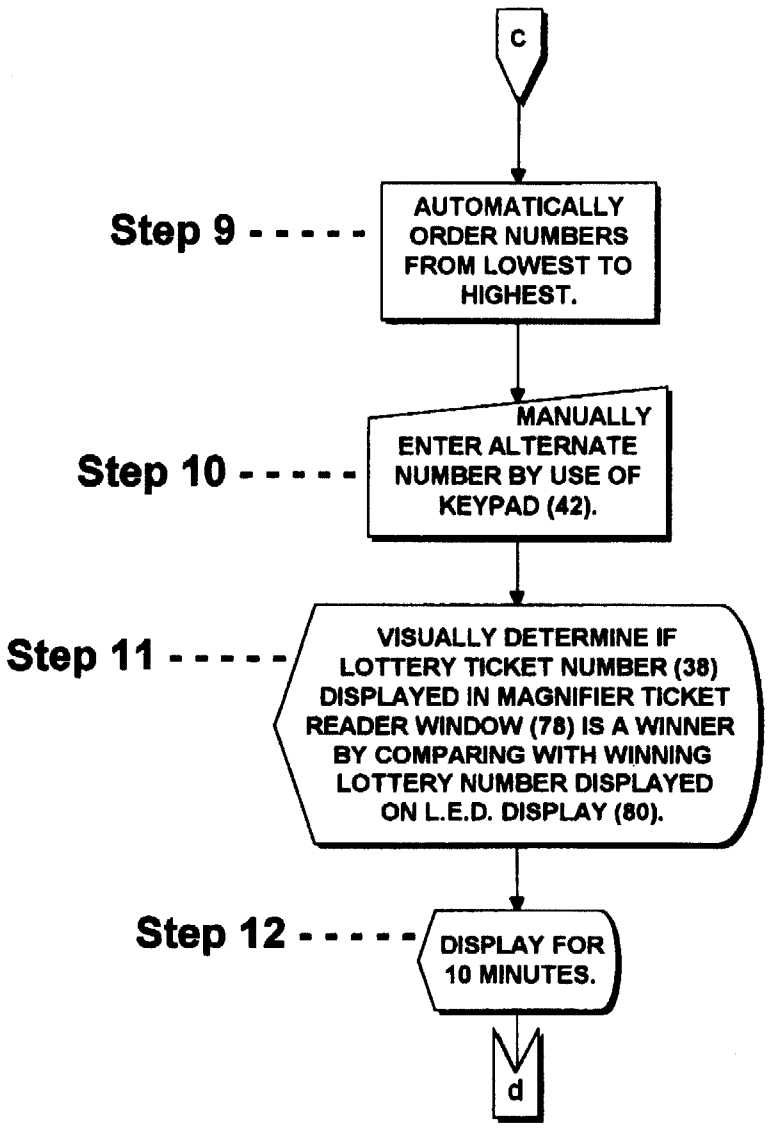
Figure 4D:
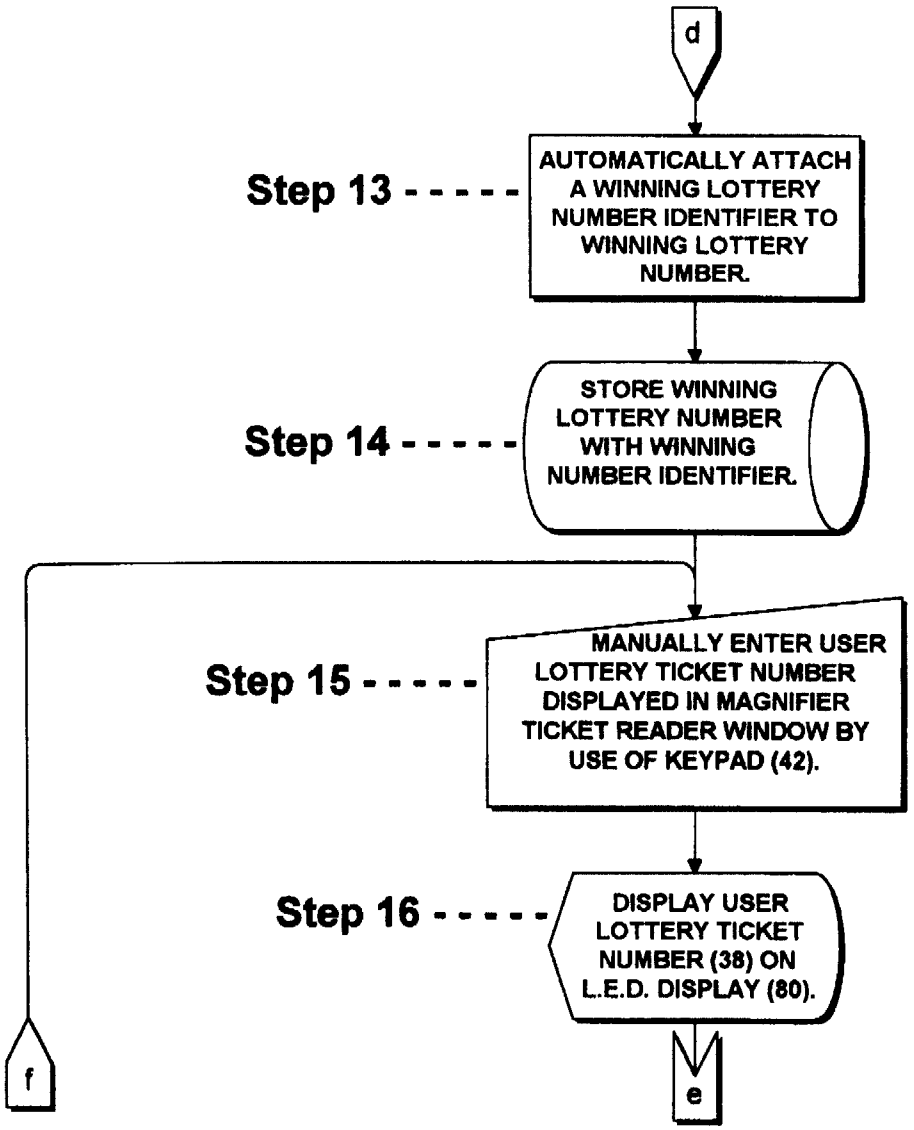
Figure 4E:
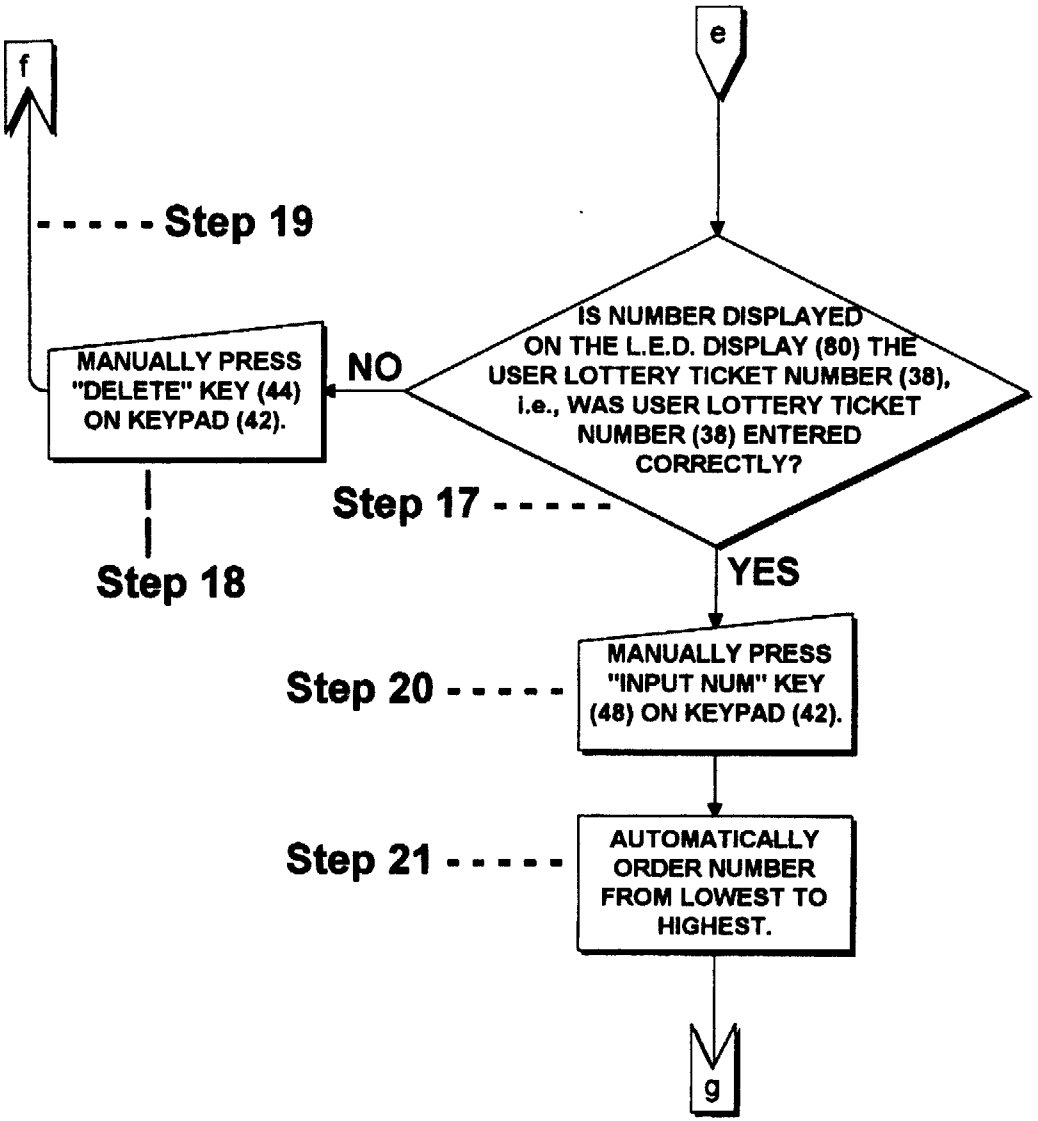
Figure 4F:
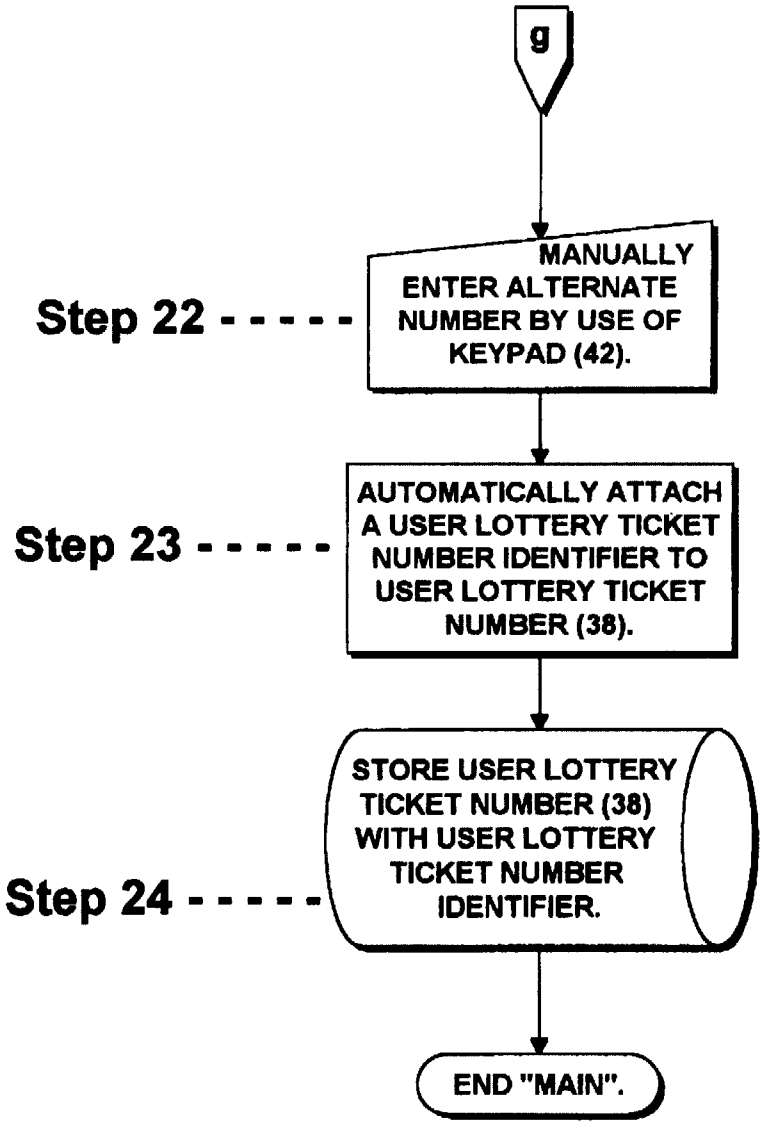

The configuration of the hand-held multi-function electronic lottery device 10 can best be seen in FIGS. 2 and 3, and as such will be discussed with reference thereto.

The hand-held multi-function electronic lottery device 10 includes a housing 18 that is hollow, thin, and generally rectangular-parallelepiped-shaped.

The housing 18 has a front 20 that is flat and rectangular-shaped, a back 22 that is parallel to, and opposes, the front 20 of the housing 18 and which is flat and rectangular-shaped and has an upper portion 24.

The housing 18 further has a top 26 that connects the front 20 of the housing to the back 22 of the housing 18 at their upper extremes, a bottom 28 that connects the front 20 of the housing to the back 22 of the housing 18 at their lower extremes, and a pair of sides 30.

The upper portion 24 of the back 22 of the housing 18 is thin and rectangular-parallelepiped-shaped, and extends rearwardly outwardly therefrom and downwardly from the top 26 of the housing 18 to generally midway between the top 26 of the housing 18 and the bottom 28 of the housing 18, and sidewardly from side to side of the pair of sides 30 of the housing 18.

The upper portion 24 of the back 22 of the housing 18 has a top 32 that is coplanar with the top 26 of the housing 18, a bottom house that is disposed midway between the top 26 of the housing 18 and the bottom 28 of the housing 18, and a slot 36 through which the user lottery ticket 16 with at least one user lottery ticket number 38 is insertable.

The slot 36 in the upper portion 24 of the back 22 of the housing 18 is transverse and parallel to the front 20 of the housing 18, and extends from, and opens into the top 32 of the upper portion 24 of the back 22 of the housing 18 to, and opens into, the bottom 34 of the upper portion 24 of the back 22 of the housing 18.

The front 20 of the housing 18 has a lower portion 40 on which is disposed a keypad 42 that is electronic and includes a "delete " key 44, a "win num" key 46, an "input num" key 48, a "pick " key 50, a "best " key 52, a "replay " key 54, a "0 " key 56, a "1" key 58, a "2" key 60, a "3" key 62, a "4" key 64, a "5" key 66, a "6" key 68, a "7" key 70, an "8" key 72, and a "9" key 74.

The front 20 of the housing 18 has an upper portion 76 on which is disposed a magnifier ticket reader window 78 that is transverse, semi-cylindrically-shaped, and communicates with the slot 36 in the upper portion 24 of the back 22 of the housing 18 so as to allow the user lottery ticket number 38 on the user lottery ticket 16 to be magnified and viewed therethrough when the user lottery ticket 16 is inserted through the slot 36 in the upper portion 24 of the back 22 of the housing 18.

The upper portion 76 of the front 20 of the housing 18 further has disposed thereon an L.E.D. display 80 which is transverse and disposed above the magnifier ticket reader window 78 on the upper portion 76 of the front 20 of the housing 18.

The upper portion 76 of the front 20 of the housing 18 further has disposed thereon a solar cell 82 which is transverse and disposed above the L.E.D. display 80 on the upper portion 76 of the front 20 of the housing 18 and powers the hand-held multi-function electronic lottery device 10 and/or recharges a battery (not shown) utilized to power the hand-held multi-function electronic lottery device 10.

The operation of the "main " routine of the hand-held multi-function electronic lottery device 10 can best be seen in FIGS. 4A–4F, and as such will be discussed with reference thereto. The "main" routine of the hand-held multi-function electronic lottery device 10 is utilized to input data.

STEP 1: Insert manually the user lottery ticket 16 in the slot 36 in the hand-held multi-function electronic lottery device 10.

STEP 2: Display the user lottery ticket number 38 in the magnifier ticket reader window 78 of the hand-held multi-function electronic lottery device 10.

STEP 3: Enter manually a winning lottery number by use of the keypad 42 of the hand-held multi-function electronic lottery device 10.

STEP 4: Display the winning lottery number on the L.E.D. display 80 of the hand-held multi-function electronic lottery device 10.

STEP 5: Determine if number displayed on the L.E.D. display 80 is the winning lottery number, ie. was the winning lottery number entered correctly?

STEP 6: Press manually a "delete" key 44 on the keypad 42, if answer to STEP 5 is no.

STEP 7: Return to STEP 3, if the "delete " key 44 on the keypad 42 has been pressed manually.

STEP 8: Press manually a "win num " key 46 on the keypad 42, if answer to STEP 5 is yes.

STEP 9: Order automatically numbers of the winning lottery number from lowest to highest so as to form an ordered winning lottery number.

STEP 10: Enter manually an alternate number to the ordered winning lottery number by use of the keypad 42.

STEP 11: Determine visually if the user lottery ticket number 38 displayed in the magnifier ticket reader window 78 is a winner by comparing it with the winning number displayed on the L.E.D. display 80.

STEP 12: Display the winning number displayed on the L.E.D. display 80 for 10 minutes.

STEP 13: Attach automatically a winning lottery number identifier to the winning lottery number.

STEP 14: Store the winning lottery number with the winning number identifier.

STEP 15: Enter manually the user lottery ticket number 38 displayed in the magnifier ticket reader window 78 by use of the keypad 42.

STEP 16: Display the user lottery ticket number 38 on the L.E.D. display 42.

STEP 17: Determine if number displayed on the L.E.D. display 80 is the user lottery ticket number 38, ie. was the user lottery ticket number 38 entered correctly?

STEP 18: Press manually the "delete"key 44 on the keypad 42, if answer to STEP 17 is no.

STEP 19: Return to STEP 15, if the "delete" key 44 on the keypad 42 has been pressed manually.

STEP 20: Press manually the "input num" key 48 on the keypad 42, if answer to STEP 17 is yes.

STEP 21: Order automatically numbers of the user lottery ticket number 38 from lowest to highest so as to form an ordered user lottery ticket number.

STEP 22: Enter manually an alternate number to the ordered user lottery ticket number by use of the keypad 42.

STEP 23: Attach automatically a user lottery ticket number identifier to the user lottery ticket number 38.

STEP 24: Store the user lottery ticket number 38 with the user lottery ticket number identifier.

Figure 5A:
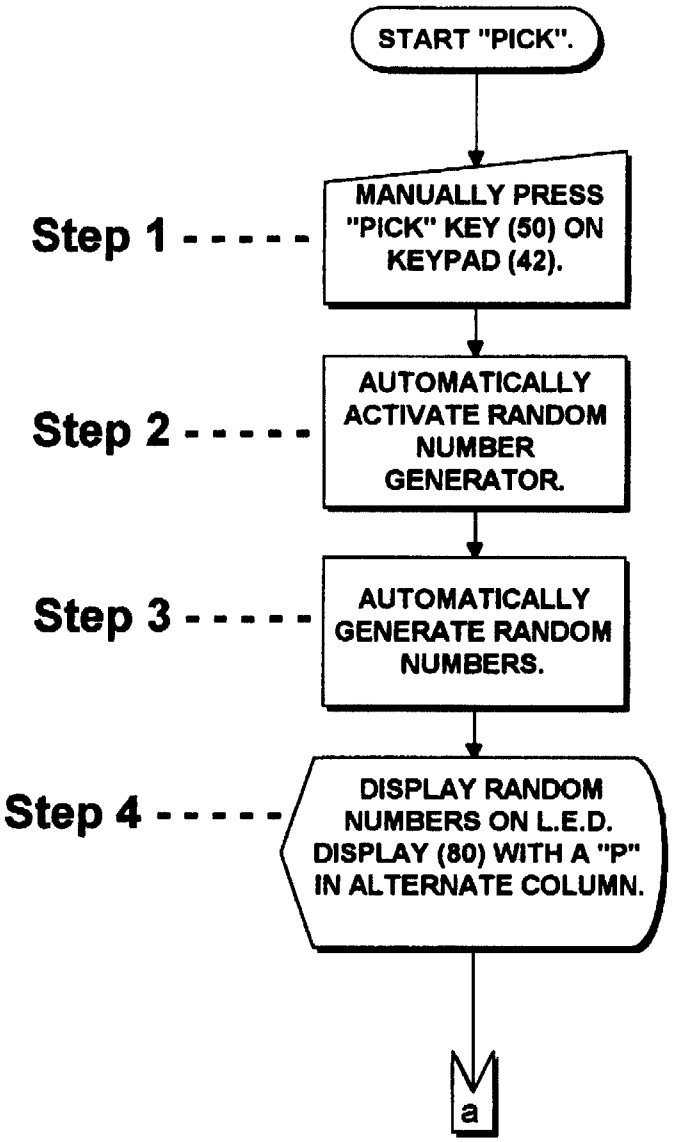
FIGS. 5A–5C is a process chart of the "pick " sub-routine of the present invention.
Figure 5B:
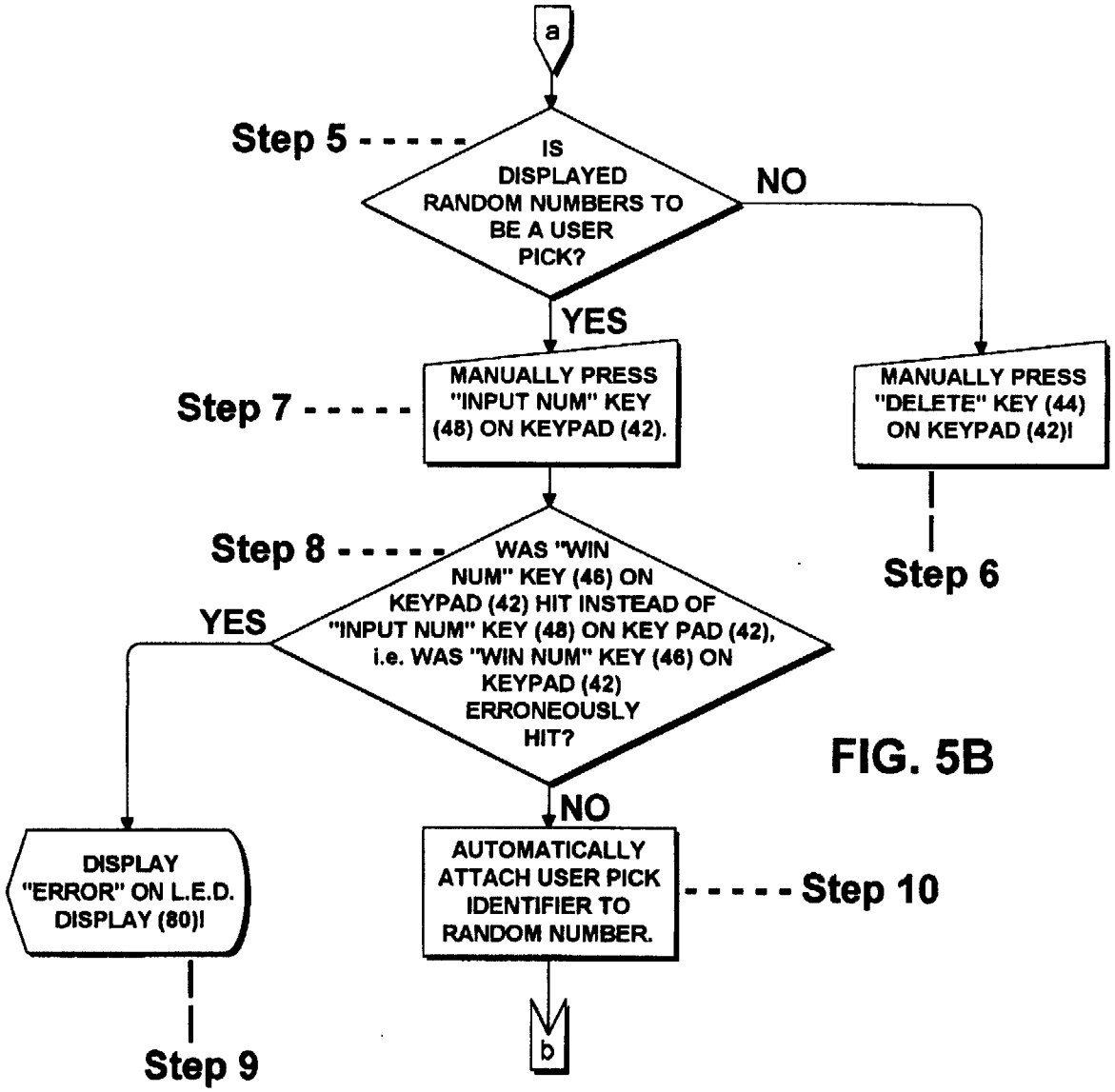
Figure 5C:
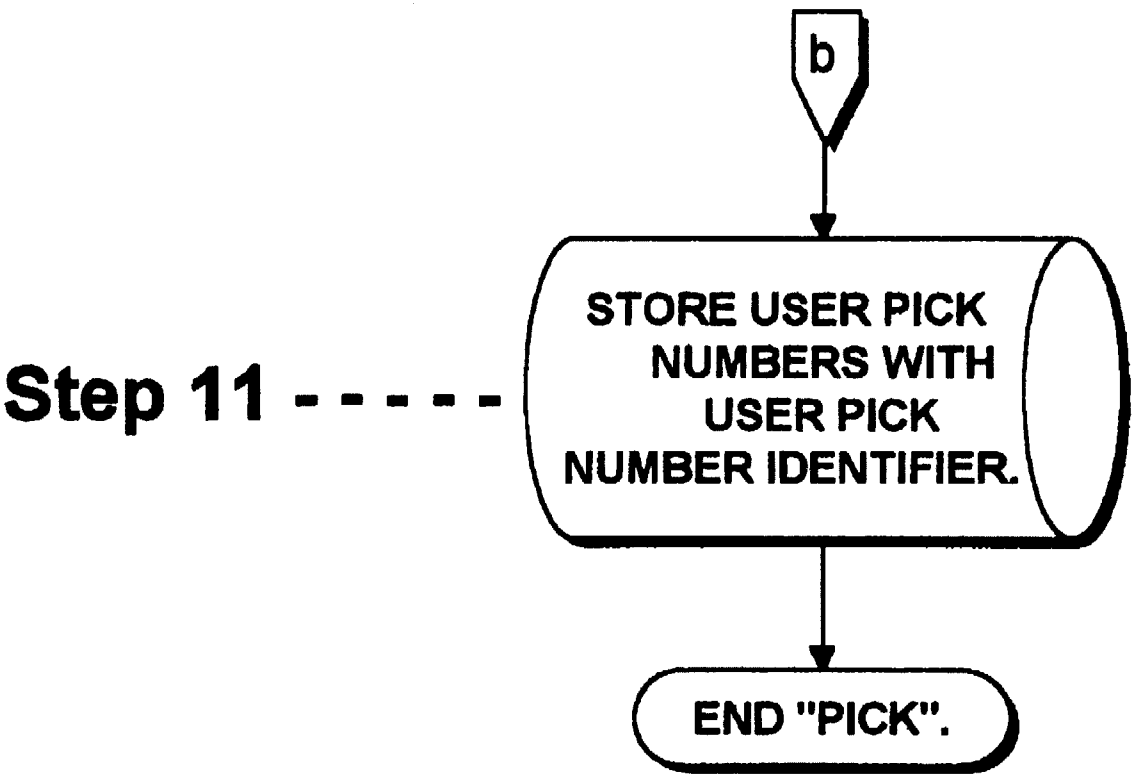

The operation of the "pick" sub-routine of the hand-held multi-function electronic lottery device 10 can best be seen in FIGS. 5A–5C, and as such will be discussed with reference thereto. The "pick" sub-routine of the hand-held multi-function electronic lottery device 10 is utilized to randomally pick numbers.

STEP 1: Press manually the "pick" key 50 on the keypad 42.

STEP 2: Activate automatically a random number generator of the hand-held multi-function electronic lottery device 10.

STEP 3: Generate automatically random numbers.

STEP 4: Display the random numbers on the L.E.D. display 80 with a "P" in an alternate column of the L.E.D. display 80 so as to form displayed random numbers.

STEP 5: Determine if the displayed random numbers is to be a user pick?

STEP 6: Press manually press the "delete" key 44 on the keypad 42, if answer to STEP 5 is no.

STEP 7: Press manually the "input num" key 48 on the keypad 42, if answer to STEP 5 is yes.

STEP 8: Determine if the "win num" key 46 on the keypad 42 was hit instead of the "input num" key 48 on the keypad 42, i.e. was the "win num" key 46 on the keypad 42 erroneously hit?

STEP 9: Display "error" on the L.E.D. display 80, if answer to STEP 8 is yes.

STEP 10: Attach automatically a user pick identifier to the random numbers so as to form user pick numbers, if answer to STEP 8 is no.

STEP 11: Store the user pick numbers with the user pick number identifier.

Figure 6A:
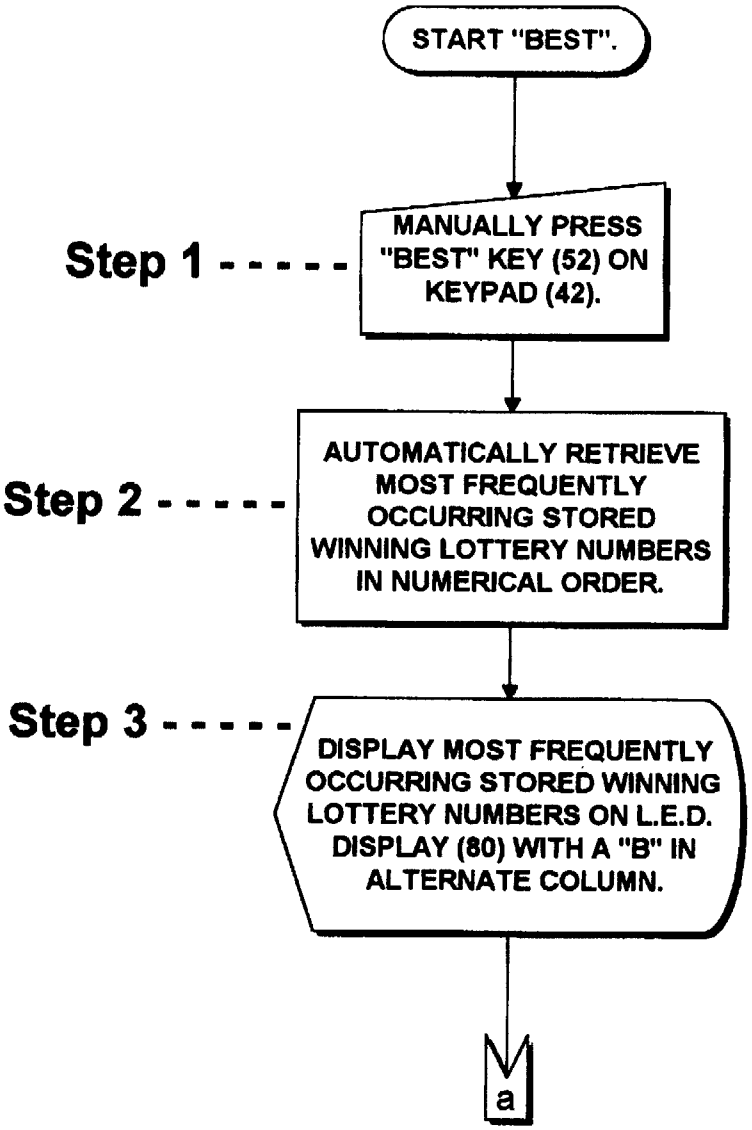
FIGS. 6A–6C is a process chart of the "best " sub-routine of the present invention.
Figure 6B:
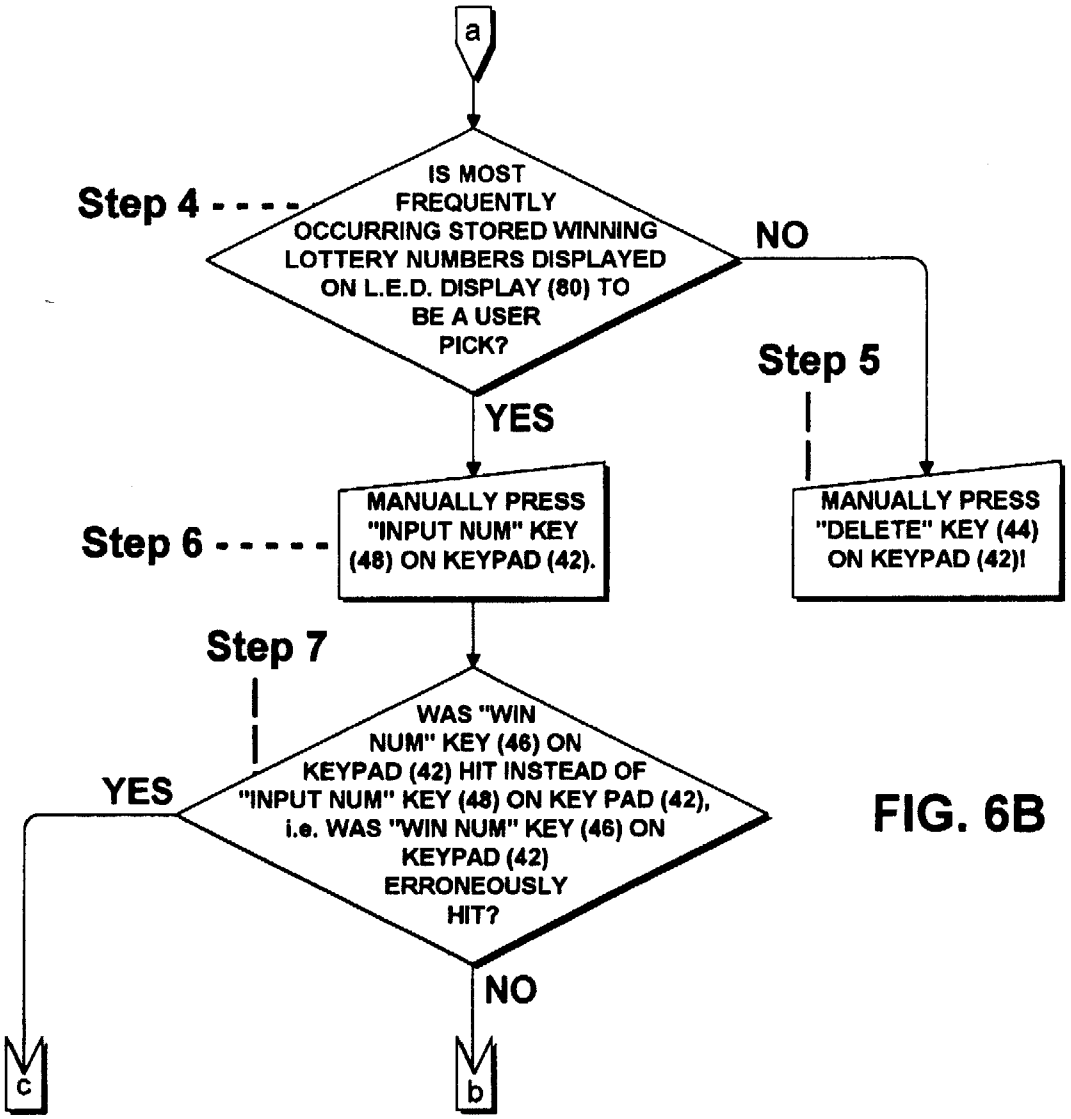
Figure 6C:
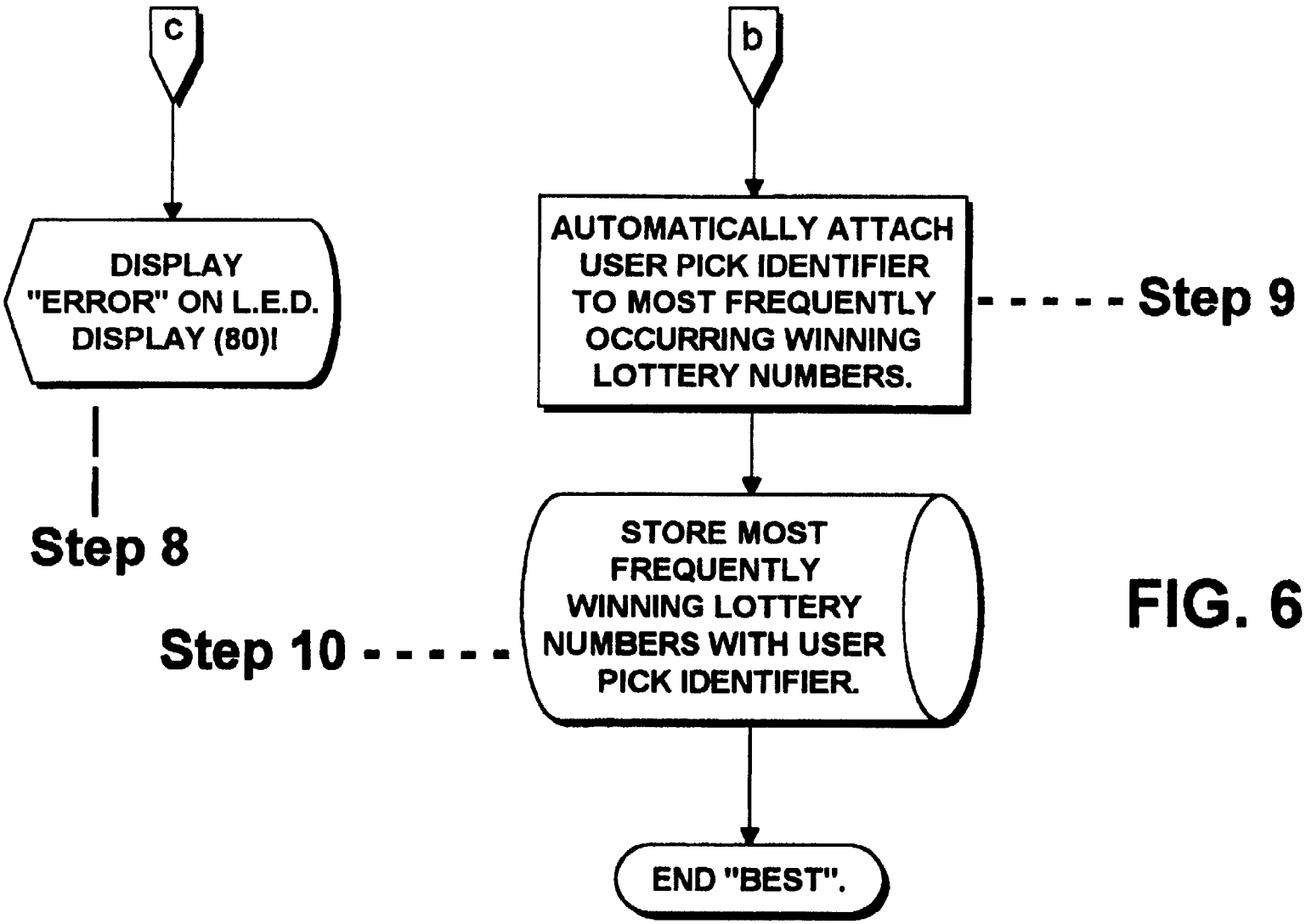

The operation of the "best" sub-routine of the hand-held multi-function electronic lottery device 10 can best be seen in FIGS. 6A–6C, and as such will be discussed with reference thereto. The "best" sub-routine of the hand-held multi-function electronic lottery device 10 is utilized to display the most frequently occurring winning lottery numbers.

STEP 1: Press manually the "best" key 52 on the keypad 42.

STEP 2: Retrieve automatically most frequently occurring stored winning lottery numbers in numerical order.

STEP 3: Display most frequently occurring stored winning lottery numbers on the L.E.D. display 80 with a "B" in the alternate column of the L.E.D. display 80.

STEP 4: Determine if the most frequently occurring stored winning lottery numbers displayed on the l.E.D. display 80 is to be a user pick?

STEP 5: Press manually the "delete " key 44 on the keypad 42, if answer to STEP 4 is no.

STEP 6: Press manually the "input num" key 48 on the keypad 42, if answer to STEP 4 is yes.

STEP 7: Determine if the "win num" key 46 on the keypad 42 was hit instead of the "input num" key 48 on the keypad 42, i.e. was the "win num" key 46 on the keypad 42 erroneously hit?

STEP 8: Display "error" on the L.E.D. display 80, if answer to STEP 7 is yes.

STEP 9: Attach automatically a user pick identifier to the most frequently occurring winning lottery numbers, if answer to STEP 7 is no.

STEP 10: Store the most frequently winning lottery numbers with the user pick identifier.

Figure 7A:
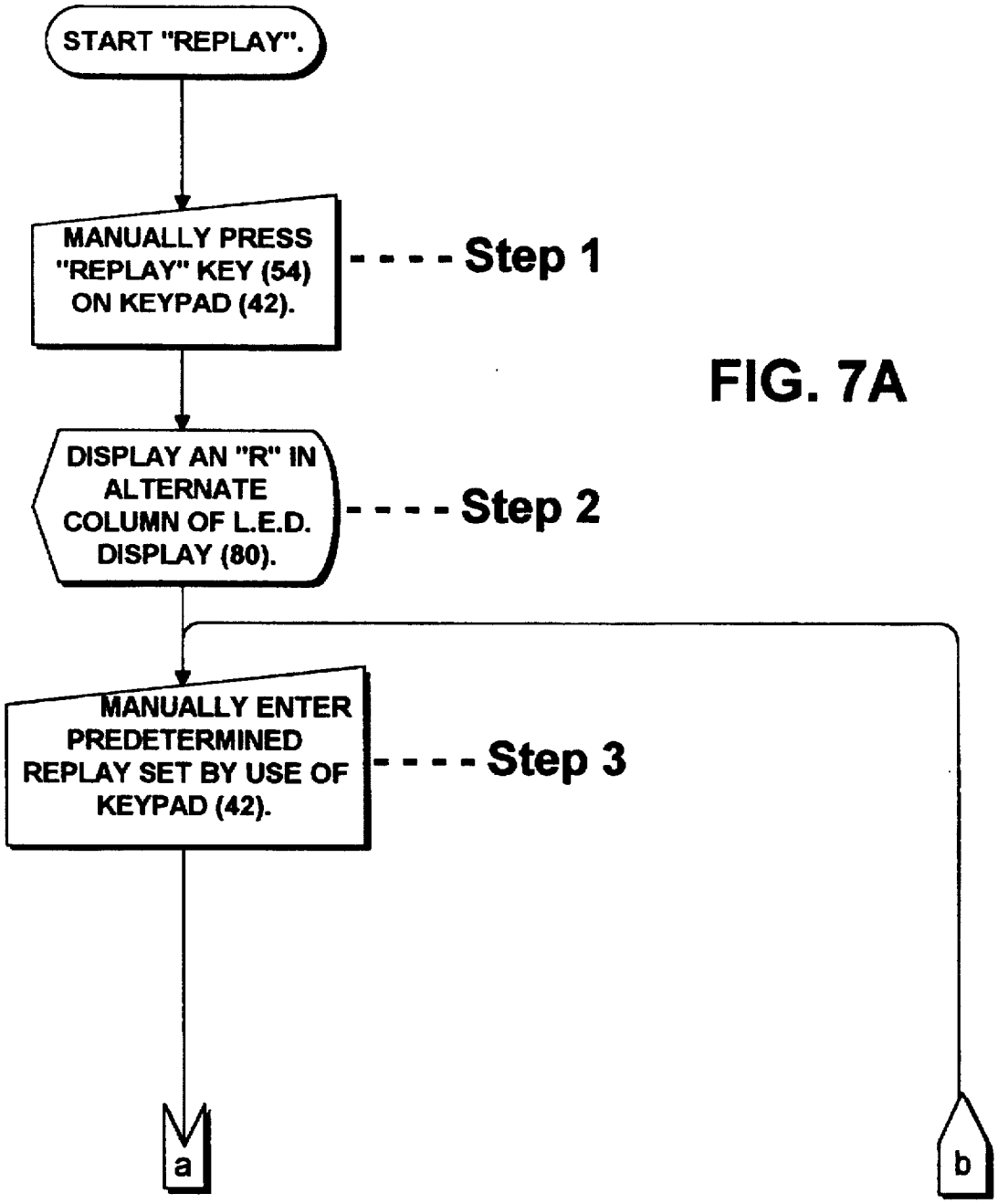
FIGS. 7A–7D is a process chart of the "replay " sub-routine of the present invention.
Figure 7B:
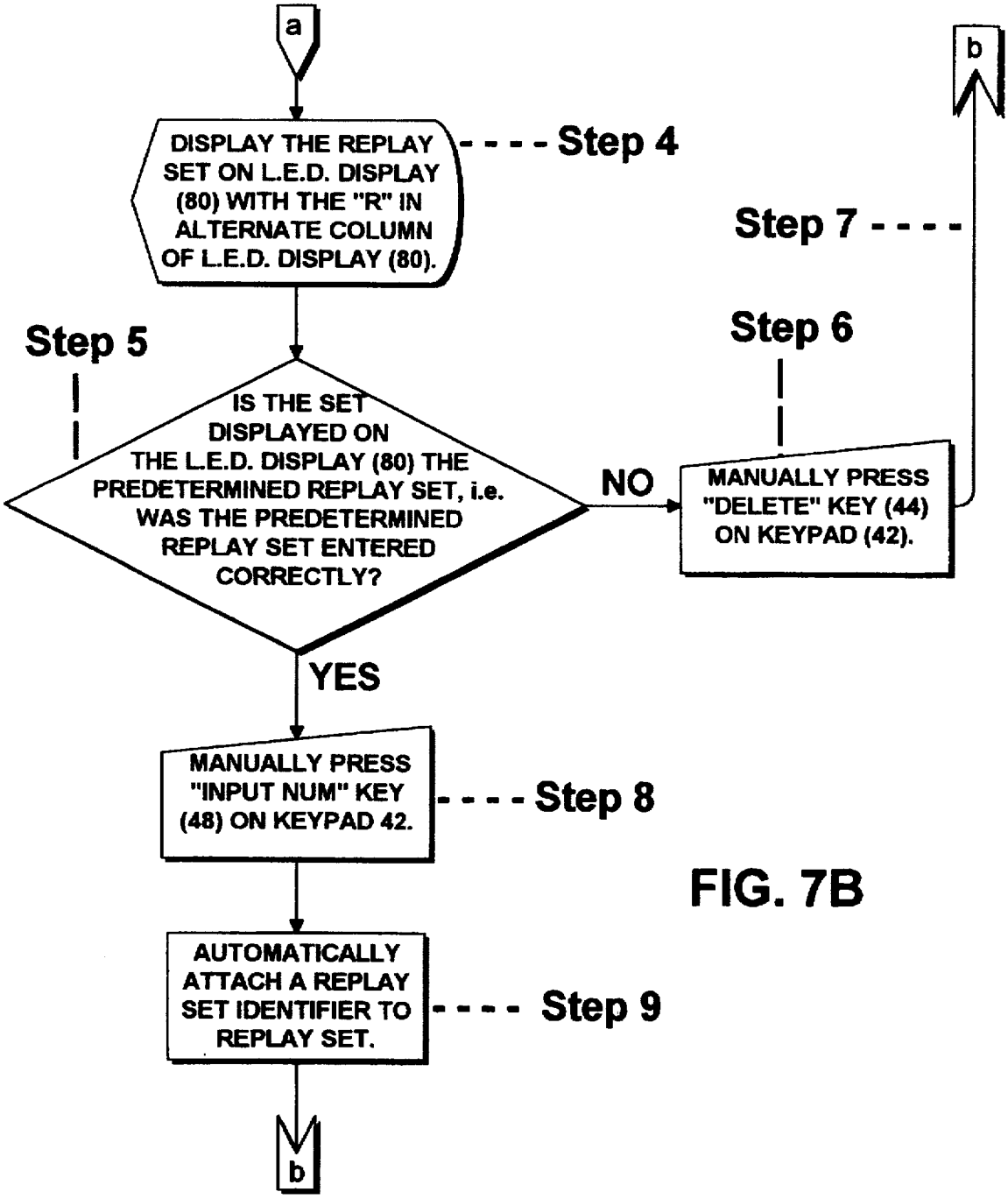
Figure 7C:
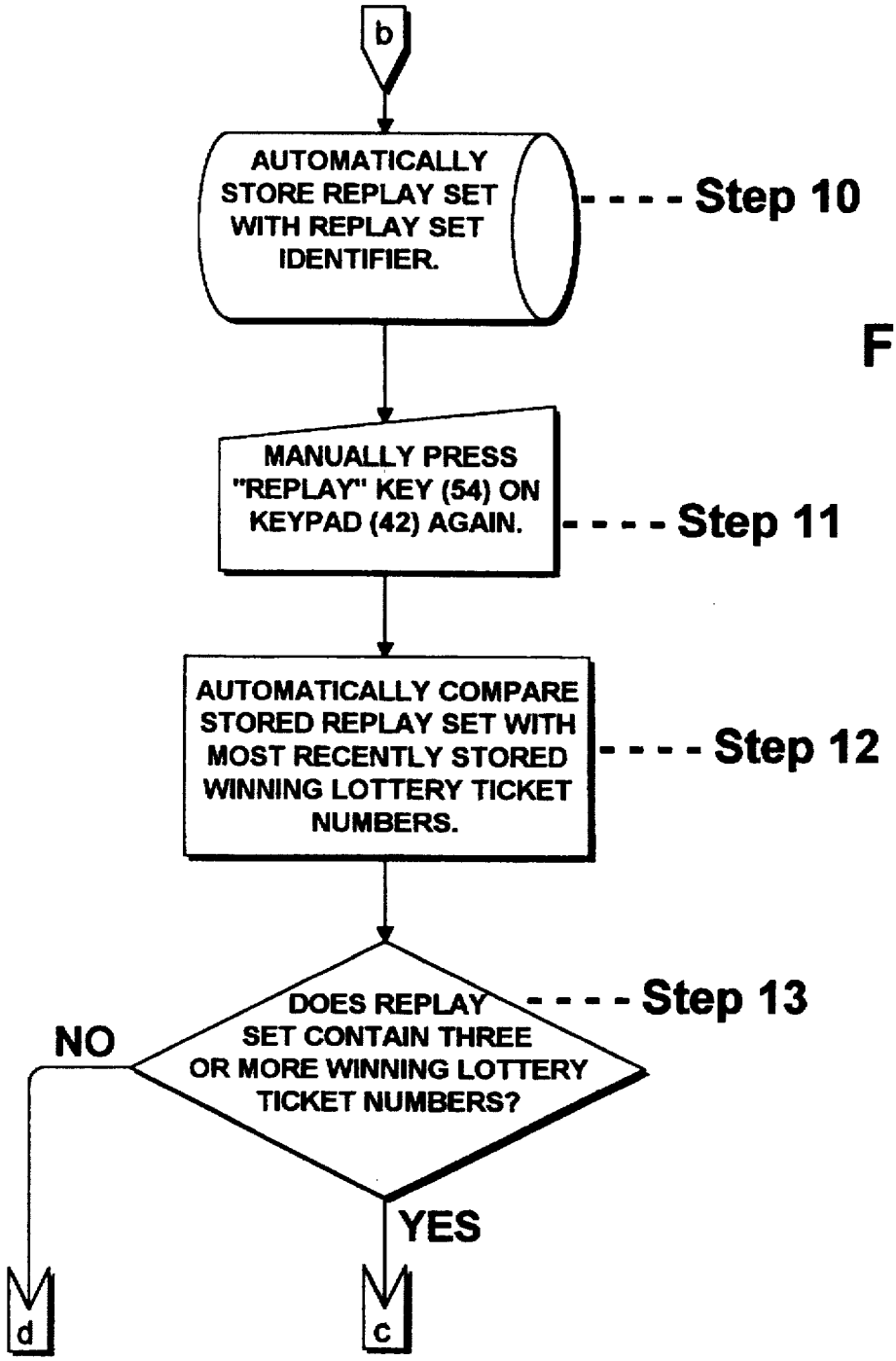
Figure 7D:
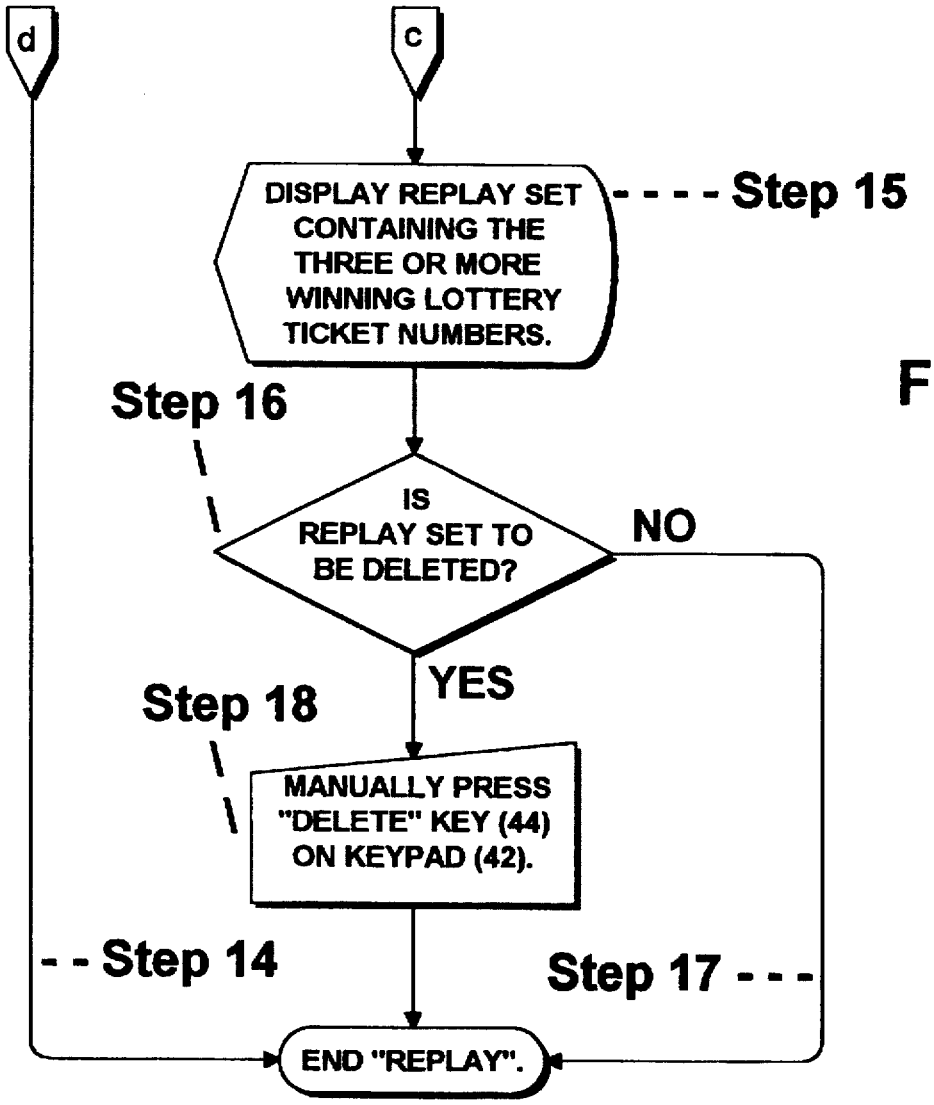

The operation of the "replay" sub-routine of the hand-held multi-function electronic lottery device 10 can best be seen in FIGS. 7A–7C, and as such will be discussed with reference thereto. The "replay" sub-routine of the hand-held multi-function electronic lottery device 10 is utilized to store a selected group of lottery numbers.

STEP 1: Press manually a "replay" key 54 on the keypad 42.

STEP 2: Display an "R" in the alternate column of the L.E.D. display 80.

STEP 3: Enter manually a predetermined replay set by use of the keypad 42.

STEP 4: Display the predetermined replay set on the L.E.D. display 80 with the "R" in the alternate column of the L.E.D. display 80.

STEP 5: Determine if the predetermined replay set displayed on the L.E.D. display 80 is the predetermined replay set, i.e. was the predetermined replay set entered correctly?

STEP 6: Press manually the "delete" key 44 on the keypad 42, if answer to STEP 5 is no, STEP 7: Return to STEP 3 if the "delete" key 44 on the keypad 42 was pressed manually.

STEP 8: Press manually the "input num" key 48 on the keypad 42, if answer to STEP 5 is yes.

STEP 9: Attach automatically a replay set identifier to the predetermined replay set.

STEP 10: Store automatically the predetermined replay set with the replay set identifier so as to form a stored replay set.

STEP 11: Press manually the "replay" key 54 on the keypad 42 again.

STEP 12: Compare automatically the stored replay set with most recently stored winning lottery numbers.

13: Determine if the stored replay set contains at least three winning lottery numbers.

STEP 14: Terminate the method if answer to STEP 13 is no.

STEP 15: Display the stored replay set containing the at least three winning lottery numbers so as to form a displayed replay set, if answer to STEP 13 is yes.

STEP 16: Determine if the displayed stored replay set is to be deleted, if answer to STEP 13 is yes.

STEP 17: Terminate the method if answer to STEP 16 is no.

STEP 18: Press manually the "delete" key 44 on the keypad 42, if answer to STEP 16 is yes.

It will be understood that each of the elements described above, or two or more together, may also find a useful application in other types of constructions differing from the types described above.

While the invention has been illustrated and described as embodied in a hand-held multi-function electronic lottery device, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A hand-held multi-function electronic lottery device holdable in a hand of a user and having a user lottery ticket with a user lottery ticket number thereon insertable therethrough comprising;

a) a housing having a front with a lower portion and an upper portion, a back with an upper portion having a slot therethrough for inserting the user lottery ticket therethrough, a top, a bottom, and a pair of sides;

b) a keypad disposed on said housing;

c) a magnifier ticket reader window disposed on said housing for allowing the user lottery ticket number on the user lottery ticket to be magnified and viewed therethrough when the user lottery ticket is inserted through said slot in said housing; and d) an L.E.D. display disposed on said housing.

2. The device as defined in claim 1, wherein said housing is hollow, thin, and generally rectangular-parallelepiped-shaped.

3. The device as defined in claim 1, wherein said front of said housing is flat and rectangular-shaped.

4. The device as defined in claim 1, wherein said back of said housing is parallel to, and opposes, said front of said housing and is flat and rectangular-shaped.

5. The device as defined in claim 1, wherein said top of said housing connects said front of said housing to said back of said housing at their upper extremes.

6. The device as defined in claim 1, wherein said bottom of said housing connects said front of said housing to said back of said housing at their lower extremes.

7. The device as defined in claim 1, wherein said upper portion of said back of said housing is thin and rectangular-parallelepiped-shaped, and extends rearwardly outwardly therefrom and downwardly from said top of said housing to generally midway between said top of said housing and said bottom of said housing, and sidewardly from side to side of said pair of sides of said housing.

8. The device as defined in claim 1, wherein said upper portion of said back of said housing has a top that is coplanar with said top of said housing, and a bottom that is disposed midway between said top of said housing and said bottom of said housing.

9. The device as defined in claim 8, wherein said slot in said upper portion of said back of said housing is transverse and parallel to said front of said housing, and extends from, and opens into said top of said upper portion of said back of said housing to, and opens into, said bottom of said upper portion of said back of said housing.

10. The device as defined in claim 1 wherein said keypad is electronic and disposed on said lower portion of said front of said housing.

11. The device as defined in claim 1, wherein said keypad includes a "delete" key, a "win num" key, an "input num" key, a "pick" key, a "best" key, a "replay" key, a "0" key, a "1" key, a "2" key, a "3" key, a "4" key, a "5" key, a "6" key, a "7" key, an "8" key, and a "9" key.

12. The device as defined in claim 1, wherein said magnifier ticket reader window is disposed on said upper portion of said front of said housing and is transverse, semi-cylindrically-shaped, and communicates with said slot in said upper portion of said back of said housing so as to allow the user lottery ticket number on the user lottery ticket to be magnified and viewed therethrough when the user lottery ticket is inserted through the slot in the upper portion of the back of the housing.

13. The device as defined in claim 12, wherein said L.E.D. display is disposed on said upper portion of said front of said housing and is transverse and disposed above said magnifier ticket reader window on said upper portion of said front of said housing.

14. The device as defined in claim 13, further comprising a solar cell disposed on said housing and accomplishing a function of at least one of powering said hand-held multi-function electronic lottery device and recharging a battery for powering said hand-held multi-function electronic lottery device.

15. The device as defined in claim 14, wherein said solar cell is disposed on said upper portion of said front of said housing and is transverse and disposed above said L.E.D. display on said upper portion of said front of said housing.

16. A method of using a hand-held multi-function electronic lottery device, comprising the steps of:

a) inserting manually a user lottery ticket in a slot in said hand-held multi-function electronic lottery device;

b) displaying a user lottery ticket number in a magnified ticket reader window of said hand-held multi-function electronic lottery device;

c) entering manually a winning lottery number by use of a keypad of said hand-held multi-function electronic lottery device;

d) displaying the winning lottery number on an L.E.D. display of said hand-held multi-function electronic lottery device;

e) determining if number displayed on said L.E.D. display is the winning lottery number;

f) pressing manually a "delete" key on said keypad, if answer to step e) is no;

g) returning to step c), if said "delete" key on said keypad has been pressed manually;

h) pressing manually a "win num" key on said keypads if answer to step e) is yes;

i) ordering automatically numbers of the winning lottery number from lowest to highest so as to form an ordered winning lottery number;

j) entering manually an alternate number to the ordered winning lottery number by use of said keypad;

k) determining visually if the user lottery ticket number displayed in said magnifier window is a winner by comparing it with the winning lottery number displayed on said L.E.D. display;

l) displaying the winning lottery number displayed on said L.E.D. display for 10 minutes;

m) attaching automatically a winning lottery number identifier to the winning lottery number;

n) storing the winning lottery number with the winning number identifier;

o) entering manually the user lottery ticket number displayed in said magnifier ticket reader window by use of said keypad;

p) displaying the user lottery ticket number on said L.E.D. display;

q) determining if number displayed on said L.E.D. display is the user lottery ticket number;

r) pressing manually said "delete" key on said keypad, if answer to step q) is no;

s) returning to step o), if "delete" key on said keypad has been pressed manually;

t) pressing manually an "input num" key on said keypad, if answer to step q) is yes;

u) ordering automatically numbers of the user lottery ticket number from lowest to highest so as to form an ordered user lottery ticket number;

v) entering manually an alternate number to the ordered user lottery ticket number by use of said keypad;

w) attaching automatically a user lottery ticket number identifier to the user lottery ticket number; and x) storing the user lottery ticket number with the user lottery ticket number identifier.

17. The method as defined in claim 16, further comprising the steps of:

a) pressing manually a "pick" key on said keypad;

b) activating automatically a random number generator of said hand-held multi-function electronic lottery device;

c) generating automatically random numbers;

d) displaying the random numbers on said L.E.D. display with a "p" in an alternate column of said L.E.D. display so as to form displayed random numbers;

e) determining if the displayed random numbers are to be a user pick;

f) pressing manually press the "delete" key on the keypad, if answer to step e) is no;

g) pressing manually the "input num" key on the keypad, if answer to step e) is yes;

h) determining if the "win num" key on said keypad was hit instead of the "input num" key on said keypad;

i) displaying "error" on said L.E.D. display, if answer to step h) is yes;

j) attaching automatically a user pick identifier to the random numbers so as to form user pick numbers, if answer to step h) is no; and k) storing the user pick numbers with the user pick number identifier.

18. The method as defined in claim 16, further comprising the steps of:

a) pressing manually a "best" key on said keypad;

b) retrieving automatically most frequently occurring winning lottery numbers in numerical order;

c) displaying the most frequently occurring winning lottery numbers on the L.E.D. display with a "B" in the alternate column of the L.E.D. display;

d) determining if the most frequently occurring winning lottery numbers displayed on the L.E.D. display is to be a user pick;

e) pressing manually the "delete" key on the keypad, if answer to step d) is no;

f) pressing manually the "input num" key on the keypad, if answer to step d) is yes;

g) determining if the "win num" key on the keypad was hit instead of the "input num" key on the keypad;

h) displaying "error" on the L.E.D. display, if answer to step g) is yes;

i) attaching automatically a user pick identifier to the most frequently occurring winning lottery numbers, if answer to step g) is no; and j) storing the most frequently occurring winning lottery numbers with the user pick identifier.

19. The method as defined in claim 16, further comprising the steps of:

a) pressing manually a "replay" key on said keypad;

b) display an "R" in said alternate column of said L.E.D. display;

c) entering manually a predetermined replay set by use of said keypad;

d) displaying the predetermined replay set on said L.E.D. display with the "R" in said alternate column of said L.E.D. display;

e) determining if the predetermined replay set displayed on said L.E.D. display is the predetermined replay set;

f) pressing manually said "delete" key on said keypad, if answer to step e) is no;

g) returning to step c) if said "delete" key on said keypad was pressed manually;

h) pressing manually said "input num" key on said keypad, if answer to step e) is yes;

i) attaching automatically a replay set identifier to the predetermined replay set;

j) storing automatically the predetermined replay set with the replay set identifier so as to form a stored replay set;

k) pressing manually said "replay" key on said keypad again;

l) comparing automatically the stored replay set with most recently stored winning lottery numbers;

m) determining if the stored replay set contains at least three winning lottery numbers;

n) terminating said method if answer to step m) is no;

o) displaying the stored replay set containing the at least three winning lottery numbers so as to form a displayed stored replay set, if answer to step m) is yes;

p) determining if the displayed stored replay set is to be deleted, if answer to step m) is yes;

q) terminating the method if answer to step p) is no; and r) pressing manually said "delete" key on said keypad, if answer to step p) is yes.

* * * * *